US007918477B2

(12) United States Patent
Wischhusen et al.

(10) Patent No.: US 7,918,477 B2
(45) Date of Patent: Apr. 5, 2011

(54) SNOWBOARD BINDING ACCESSORY

(76) Inventors: Rene Wischhusen, Shirley, NY (US); James Wischhusen, Shirley, NY (US)

( * ) Notice: Subject to any disclaimer, the term of this patent is extended or adjusted under 35 U.S.C. 154(b) by 313 days.

(21) Appl. No.: 12/264,206

(22) Filed: Nov. 3, 2008

(65) Prior Publication Data

US 2010/0109289 A1 May 6, 2010

(51) Int. Cl.
*A63C 9/081* (2006.01)

(52) U.S. Cl. ..... 280/618; 280/613

(58) Field of Classification Search ..... 280/607, 280/14.24, 617, 618, 620, 613, 626, 629, 280/633, 636
See application file for complete search history.

(56) References Cited

U.S. PATENT DOCUMENTS

| | | | | | |
|---|---|---|---|---|---|
| 4,196,920 | A | * | 4/1980 | Salomon | 280/613 |
| 5,035,443 | A | | 7/1991 | Kincheloe | |
| 5,044,654 | A | * | 9/1991 | Meyer | 280/613 |
| 5,354,088 | A | | 10/1994 | Vetter et al. | |
| 5,520,405 | A | | 5/1996 | Bourke | |
| 5,586,779 | A | * | 12/1996 | Dawes et al. | 280/14.24 |
| 5,695,210 | A | | 12/1997 | Goss et al. | |
| 5,791,678 | A | * | 8/1998 | Perlman | 280/618 |
| 5,820,155 | A | | 10/1998 | Brisco | |
| 5,826,910 | A | | 10/1998 | Ricks | |
| 5,876,045 | A | * | 3/1999 | Acuna, Jr. | 280/14.24 |
| 5,913,530 | A | | 6/1999 | Berger et al. | |
| 5,975,554 | A | * | 11/1999 | Linton | 280/607 |
| 6,022,040 | A | | 2/2000 | Buzbee | |
| 6,029,991 | A | | 2/2000 | Frey | |
| 6,065,768 | A | | 5/2000 | Lee | |
| 6,135,486 | A | | 10/2000 | Neiley | |
| 6,196,569 | B1 | * | 3/2001 | Berger et al. | 280/607 |
| 6,299,192 | B1 | | 10/2001 | Bryce | |
| 6,318,749 | B1 | * | 11/2001 | Eglitis et al. | 280/607 |
| 6,343,809 | B1 | | 2/2002 | Karol | |
| 6,499,760 | B1 | | 12/2002 | Tindall et al. | |
| 6,575,489 | B1 | | 6/2003 | White | |
| 6,722,688 | B2 | | 4/2004 | Poscich | |
| 6,923,454 | B2 | | 8/2005 | Drako | |
| 7,267,357 | B2 | * | 9/2007 | Miller et al. | 280/617 |
| 7,270,337 | B1 | | 9/2007 | Carotenuto | |
| 7,290,785 | B2 | | 11/2007 | Dixon | |
| 2003/0146588 | A1 | | 8/2003 | Fiebing | |
| 2004/0262862 | A1 | | 12/2004 | Orr et al. | |
| 2005/0029757 | A1 | | 2/2005 | Fiebing | |
| 2005/0062260 | A1 | | 3/2005 | Elkington et al. | |
| 2007/0013165 | A1 | | 1/2007 | Panzeri | |

FOREIGN PATENT DOCUMENTS

| | | |
|---|---|---|
| WO | WO/96/23557 | 8/1996 |

* cited by examiner

*Primary Examiner* — J. Allen Shriver, II
*Assistant Examiner* — John D Walters
(74) *Attorney, Agent, or Firm* — Antoinette M. Tease

(57) ABSTRACT

A snowboard binding accessory comprising a binding interface and snowboard interface, wherein the binding interface comprises a platform, and the snowboard interface comprises first and second discs. The platform is attached to a snowboard strap binding, and the first and second discs are fixedly attached to a snowboard. The platform comprises a circular recess that fits over the first disc. The second disc provides a rotating surface for the platform. The first disc comprises a channel that extends around the perimeter of the disc. Notches extend from the top surface of the first disc to the channel, and knobs extend horizontally from the side walls of the platform into the recess. To position the platform on the snowboard interface, the knobs are lined up with the notches, and the first disc is inserted into the recess. The knobs move horizontally within the channel, thereby allowing the platform to rotate.

6 Claims, 10 Drawing Sheets

SNOWBOARD BINDING ACCESSORY

BACKGROUND OF THE INVENTION

1. Field of the Invention

The present invention relates generally to the field of snowboarding, and more particularly, to a snowboard binding accessory that allows the snowboarder to (i) remove her boot from the strap binding without unstrapping the boot from the binding and (ii) rotate her foot on the snowboard without having to take the bindings and board into the shop.

2. Description of the Related Art

Snowboard bindings generally fall into two categories: strap and step-in. Both strap and step-in bindings are fixedly attached to the snowboard. With strap bindings, the boot is strapped into the binding; with step-in bindings, the snowboarder simply steps down and clicks into the binding. Step-in bindings are easier to get into and out of than strap bindings, but strap bindings generally provide greater control. In addition, step-in bindings require a somewhat stiffer boot than strap bindings. Thus, strap bindings are generally preferred, despite the inconveniences of using them.

Strap bindings are particularly inconvenient when boarding or disembarking from the chairlift, and existing strap bindings do not provide the snowboarder with the ability to adjust her stance on the board without taking the bindings and board into the shop to be readjusted. To board a chairlift, the snowboarder must unstrap her right foot from the snowboard binding and ride the chairlift with the right foot free and the left foot still attached to the snowboard (via the binding) at an angle that is roughly perpendicular to the snowboard. When the snowboarder disembarks from the chairlift, she must restrap her right foot into the binding. All of this time spent strapping and unstrapping is time that is not spent on the slopes.

A further problem with both strap and step-in bindings is that the snowboarder cannot adjust her stance on the snowboard without talking the bindings and board into the shop to be readjusted. Thus, while boarding, riding and disembarking from the chairlift, or while "skating" (i.e., moving forward with only one foot on the board), the snowboarder's left foot is at an angle that is roughly perpendicular to the snowboard, resulting in an uncomfortable and awkward position for the snowboarder. Moreover, the snowboarder has no ability to adjust her stance while on the slopes.

What is needed is a snowboard binding accessory that (i) eliminates the awkward stance while the snowboarder is boarding, riding and disembarking from the chairlift or "skating" and (ii) allows the snowboarder to change her stance while on the slopes. Accordingly, it is an object of the present invention to provide these advantages in a snowboard binding accessory that combines the convenience of a step-in binding with the security of a strap binding.

BRIEF SUMMARY OF THE INVENTION

The present invention is a snowboard binding accessory comprising: a binding interface comprising a platform; and a snowboard interface comprising a first disc and a second disc; wherein the platform is fixedly attached to a bottom surface of a snowboard strap binding; wherein the first and second discs are fixedly attached to a snowboard with the first disc lying on top of the second disc; wherein the platform comprises a circular recess that fits over the first disc; wherein the first and second discs each has an outer diameter and the recess has an inner diameter; wherein the outer diameter of the first disc is roughly the same as the inner diameter of the recess in the platform; wherein the outer diameter of the second disc is greater than the outer diameter of the first disc; wherein the second disc provides a rotating surface for the platform; wherein the first disc comprises a top surface, a perimeter, and a channel that extends around the perimeter of the first disc; wherein a plurality of notches extend from the top surface of the first disc to the channel; wherein the recess in the platform has side walls, and a plurality of knobs extend horizontally from the side walls into the recess; wherein the number of knobs equals the number of notches; wherein to position the platform on the snowboard interface, the knobs are lined up with the notches, and the first disc is inserted into the recess; and wherein the knobs move horizontally within the channel in the first disc, thereby allowing the platform to rotate.

In a preferred embodiment, the first disc has a height and the recess has a depth, and the height of the first disc is roughly equal to the depth of the recess. In yet another preferred embodiment, each knob has a length and each notch has a depth, and the length of each knob roughly equals the depth of each notch.

In a preferred embodiment, the present invention further comprises a clamp with a tip, and the clamp is positioned such that when the clamp is in a locked position, the tip of the clamp extends into the channel in the first disc, thereby preventing the platform from rotating.

In a preferred embodiment, the first disc comprises a beveled top edge and the recess comprises a beveled bottom edge, and the beveled edges of the first disc and recess facilitate the coupling of the first disc and recess.

In a preferred embodiment, the channel in the first disc is fully covered by the platform when the platform is on top of the first disc, thereby preventing snow, dirt and debris from entering the channel and disrupting the smooth rotation of the platform.

REFERENCE NUMBERS

Figure 1:
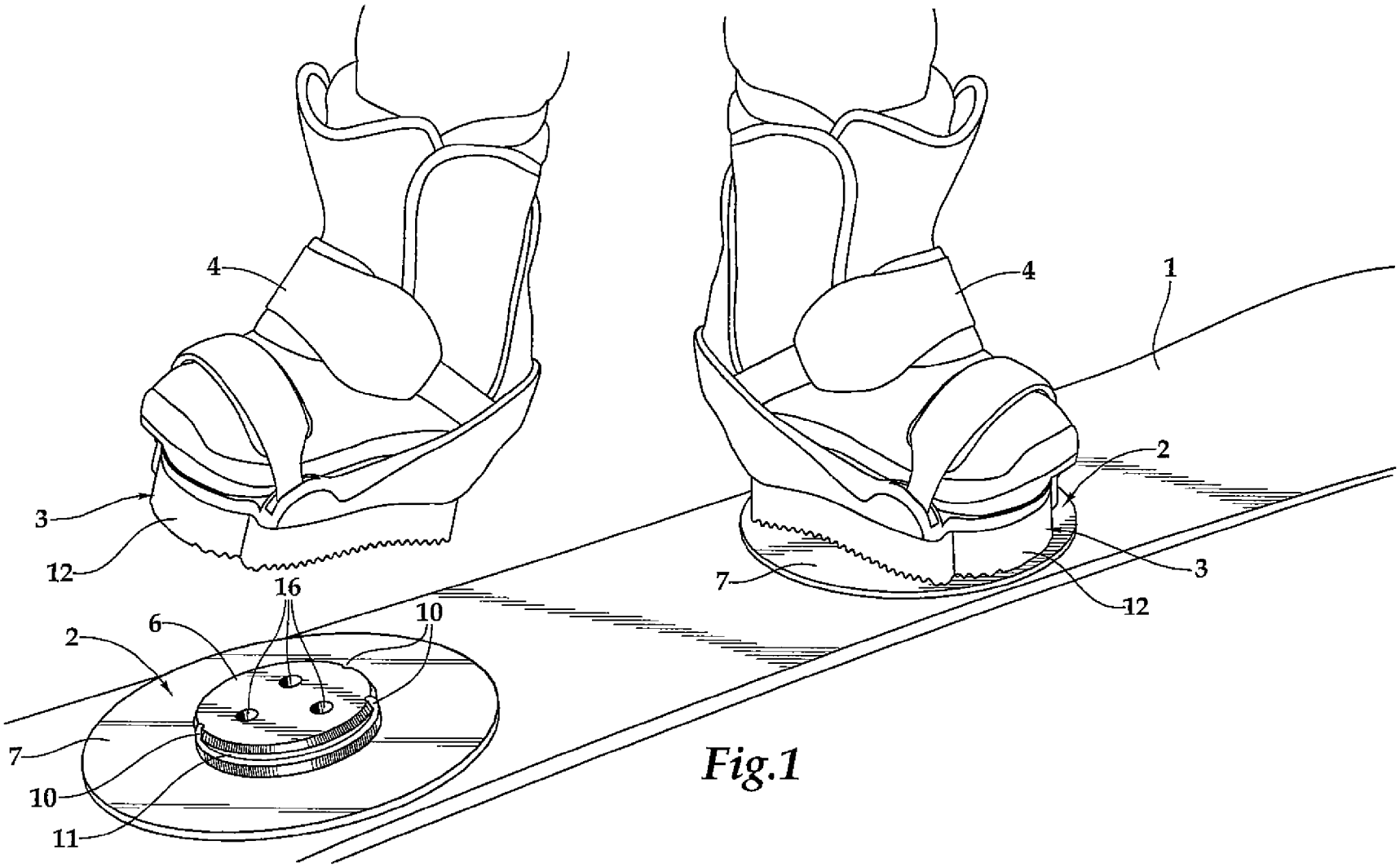
FIG. 1 is a perspective view of a person with her right foot positioned above the snowboard interface of the present invention.

1 Snowboard
2 Snowboard interface
3 Binding interface
4 Binding
5 Clamp
6 First disc of snowboard interface
7 Second disc of snowboard interface
8 Bolt (connecting first, second and third discs to snowboard)
9 Third disc of snowboard interface
10 Notch
11 Channel
12 Platform
13 Bolt (connecting platform to binding)
14 Recess (in bottom of platform)
15 Knob
16 Hole (in recess of platform)

DETAILED DESCRIPTION OF INVENTION

FIG. 1 is a perspective view of a person with her right foot positioned above the snowboard interface of the present invention. This figure shows a snowboard 1, the snowboard interface 2, the binding interface 3, and the strap binding 4. The present invention is intended to be an accessory to strap snowboard bindings. In this figure, the snowboarder's right foot (or what would be the rear foot when snowboarding) is positioned above the snowboard interface 2. This is the position in which the snowboarder would be prior to placing her right foot on the board. (Note that all references herein to the right foot as the "rear" foot and the left foot as the "front" foot may be reversed such that the right foot is the "rear" foot and the left foot is the "front" foot.)

Figure 2:
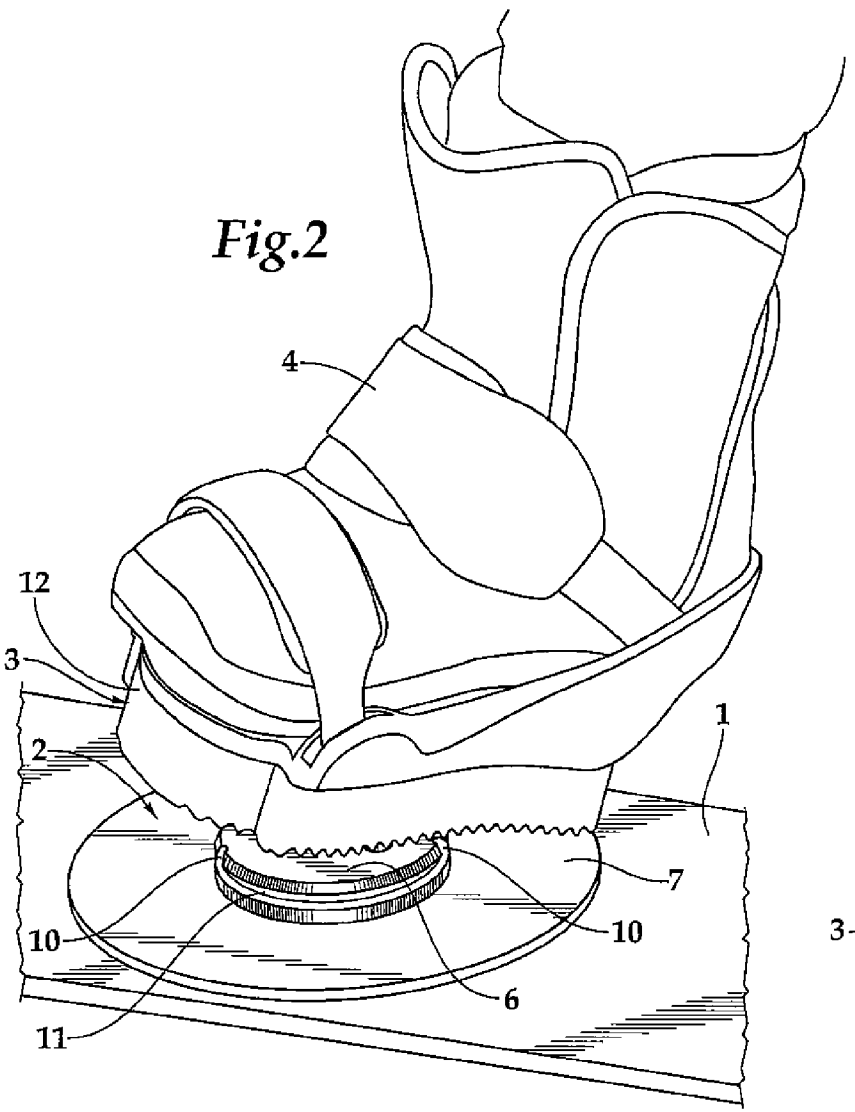
FIG. 2 is a perspective view of the same right foot shown in FIG. 1 with the binding interface positioned over the top of the snowboard interface of the present invention.

FIG. 2 is a perspective view of the same right foot shown in FIG. 1 with the binding interface positioned over the top of the snowboard interface of the present invention. In this figure, the binding interface 3 is about to be placed on top of the snowboard interface 2. Note that the foot is turned in an unnatural position (outward) for purposes of placing the boot on the board.

Figure 3:
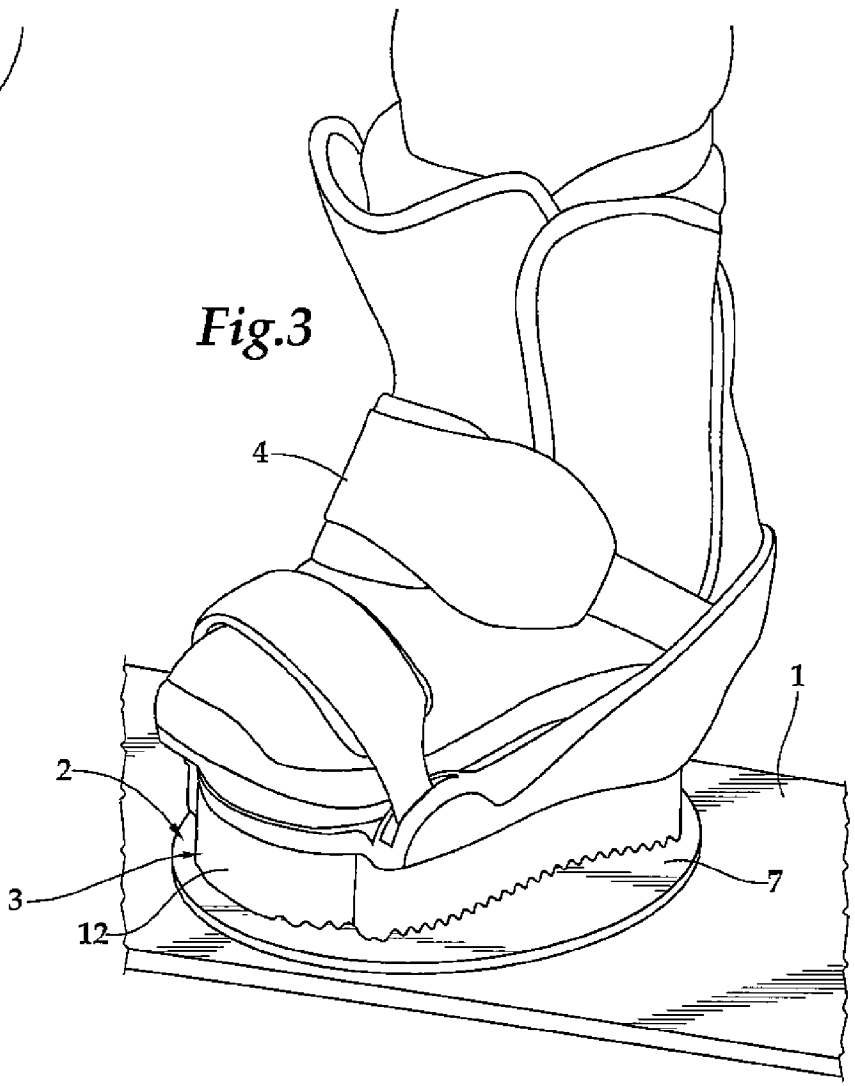
FIG. 3 is a perspective view of the same right foot shown in FIGS. 1 and 2 with the binding interface positioned on top of the snowboard interface of the present invention.

FIG. 3 is a perspective view of the same right foot shown in FIGS. 1 and 2 with the binding interface positioned on top of the snowboard interface of the present invention. In this figure, the binding interface 3 has now been placed directly on top of the snowboard interface. As shown in this figure, the bottom face of the binding interface 3 is positioned directly on top of the second disc 7 (see FIG. 9) of the snowboard interface 2.

Figure 4:
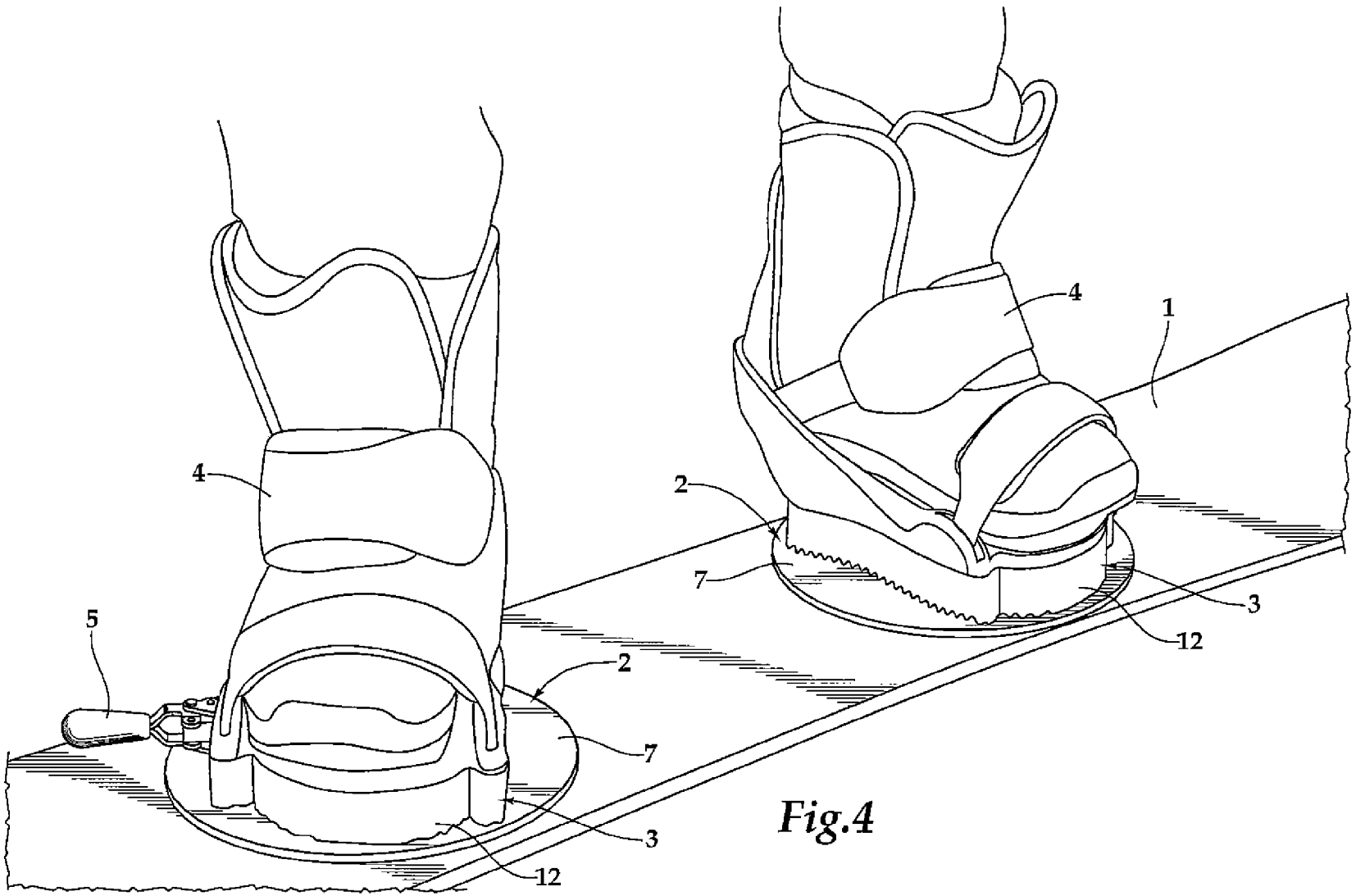
FIG. 4 is a perspective view of a person with the binding interface of the right foot positioned on top of the snowboard interface of the present invention before the right foot is turned into locking position.

FIG. 4 is a perspective view of a person with the binding interface of the right foot positioned on top of the snowboard interface of the present invention before the right foot is turned into locking position. In this figure, the right foot of the snowboarder is in the position as that shown in FIG. 3. This figure, however, shows the clamp 5 on the outside of the binding interface 3. (Note that the clamp may be positioned on the outside or the inside of the binding interface 3.) The clamp 5 is in an open position because the snowboarder has not yet rotated her foot into the position in which it will be when the clamp is moved into a locked position.

Figure 5:
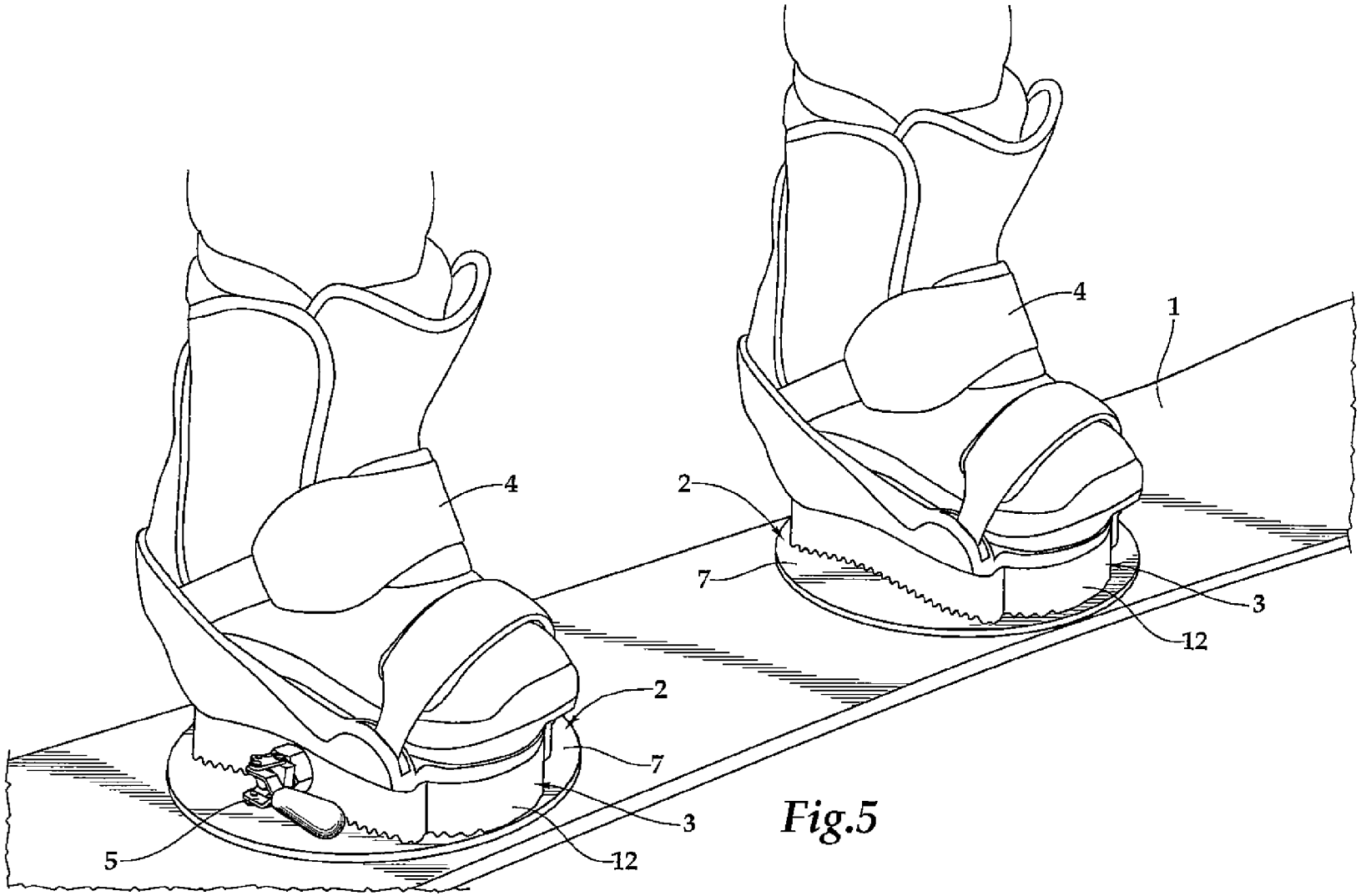
FIG. 5 is the same view as shown in FIG. 4 except that the right foot has been turned into locking position and the clamp is in a locked position.

FIG. 5 is the same view as shown in FIG. 4 except that the right foot has been turned into locking position and the clamp is in a locked position. In this figure, the right foot has been rotated so that it is in the same position relative to the snowboard 1 as the left foot. The clamp 5 is now in a locked position. The position shown in this figure approximates the position of the feet during snowboarding.

Figure 6:
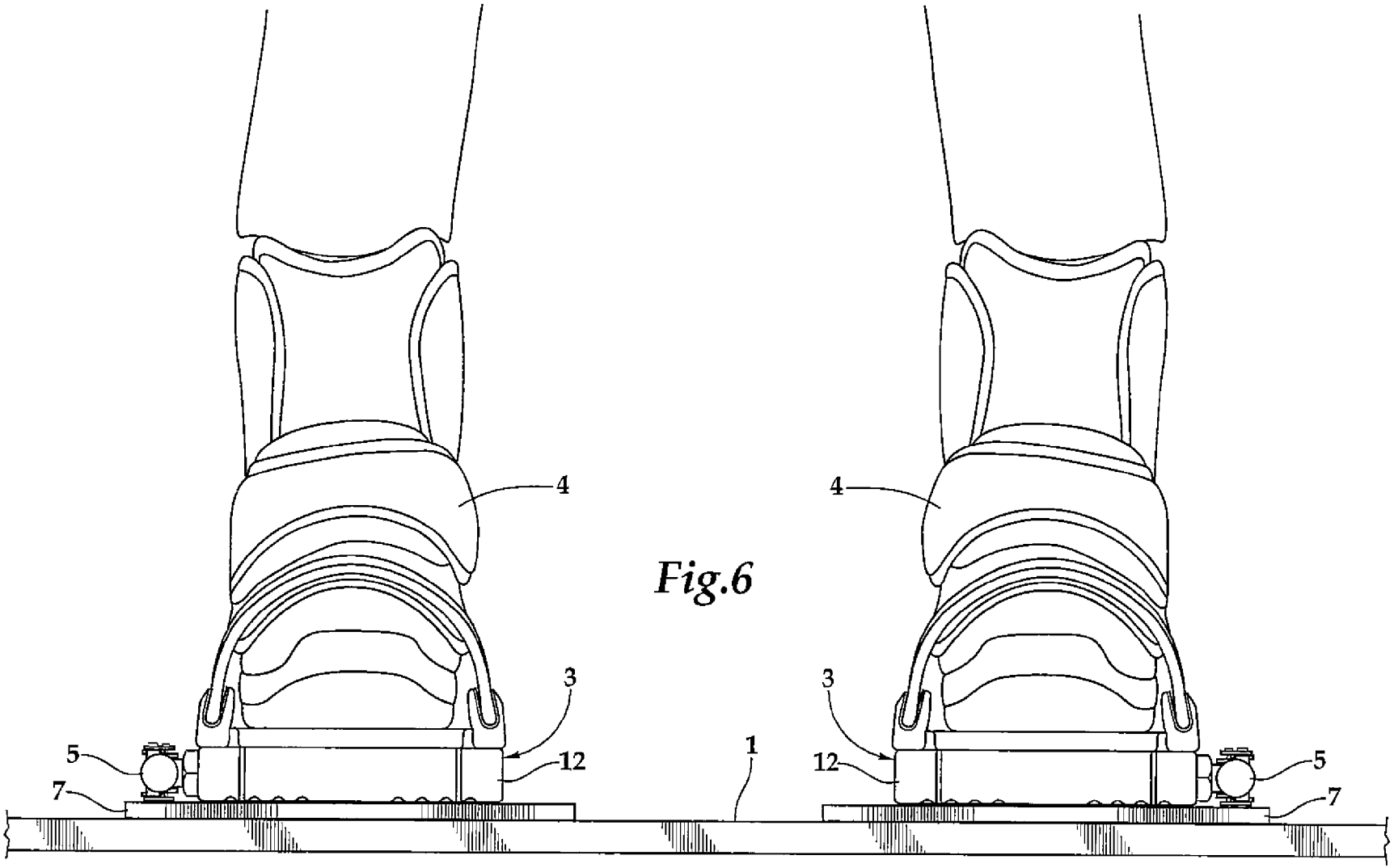
FIG. 6 is a front view of the same position shown in FIG. 5.

FIG. 6 is a front view of the same position shown in FIG. 5. (In this context, "front" refers to the front of the feet and not the front of the snowboard.) This figure shows the clamps 5 on the outside of the binding interface 3 of both the right and left feet. In a preferred embodiment, the binding interface 3 and snowboard interface 2 of the present invention are used in connection with both the right and left feet; however, it would be possible (though not as effective) to use the binding interface 3 and snowboard interface 2 with only the right (rear) foot, as long as the left (front) foot was on the same horizontal plane as the right foot. In this figure, both clamps 5 are in a locked position.

As shown in FIG. 6, the binding interface 3 lifts the snowboarder's boots up off of the snowboard, which is advantageous for snowboarders whose feet are longer than the width of the snowboard because it prevents their feet from dragging on the snow. It also allows snowboarders to make sharper toeside and heelside turns with less effort.

Figure 7:
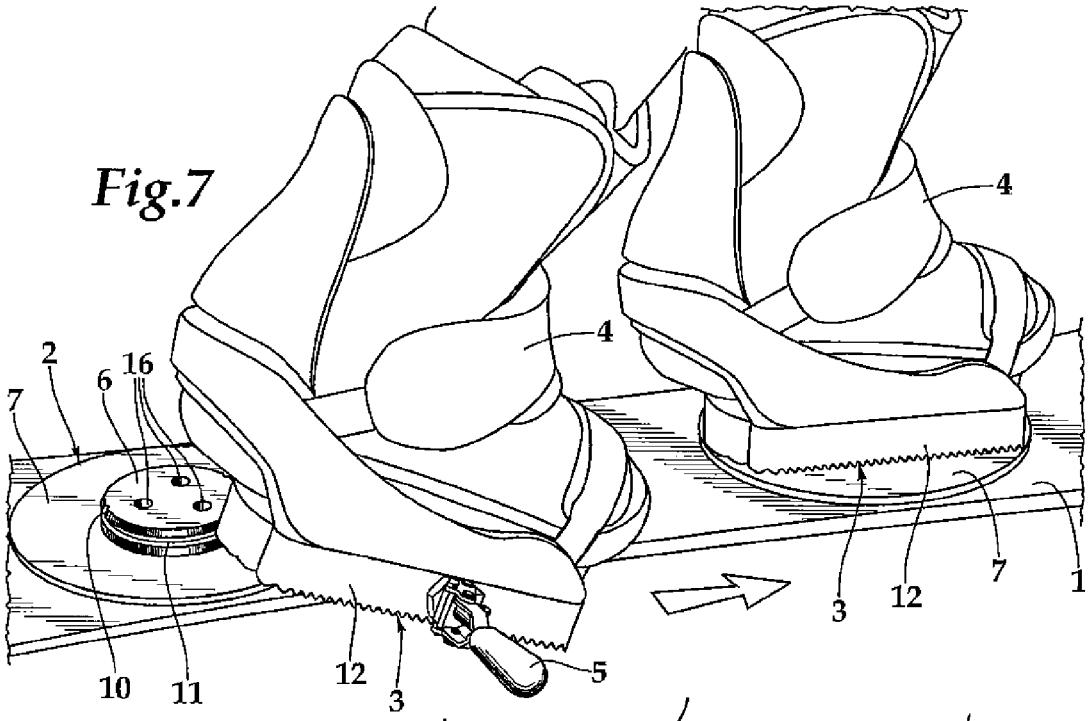
FIG. 7 is a perspective view of the left (or front) foot of the snowboarder rotated into skating position and the right (or rear) foot of the snowboarder lifted off of the snowboard.

FIG. 7 is a perspective view of the left (or front) foot of the snowboarder rotated into "skating" position and the right (or rear) foot of the snowboarder lifted off of the snowboard. The direction of travel is indicated with an arrow. In this figure, the right foot has been rotated and lifted off of the snowboard interface 2, and the front foot has been rotated so that it is parallel with the snowboard 1. This is the position in which the snowboarder would be when "skating" with the tip and tail of the snowboard both on the same axis of travel. With current snowboard binding technologies, the rear foot can only be removed from the board by unstrapping the straps on the binding 4, and the front foot cannot be rotated. This results in lost time as the snowboarder straps in and out of her bindings every time she rides the chairlift, and it also requires the snowboarder to "skate" forward in an unnatural position—with the front foot roughly perpendicular to the snowboard and the front and rear feet roughly perpendicular to each other. This position results in an unnatural twisting of the body.

Figure 8:
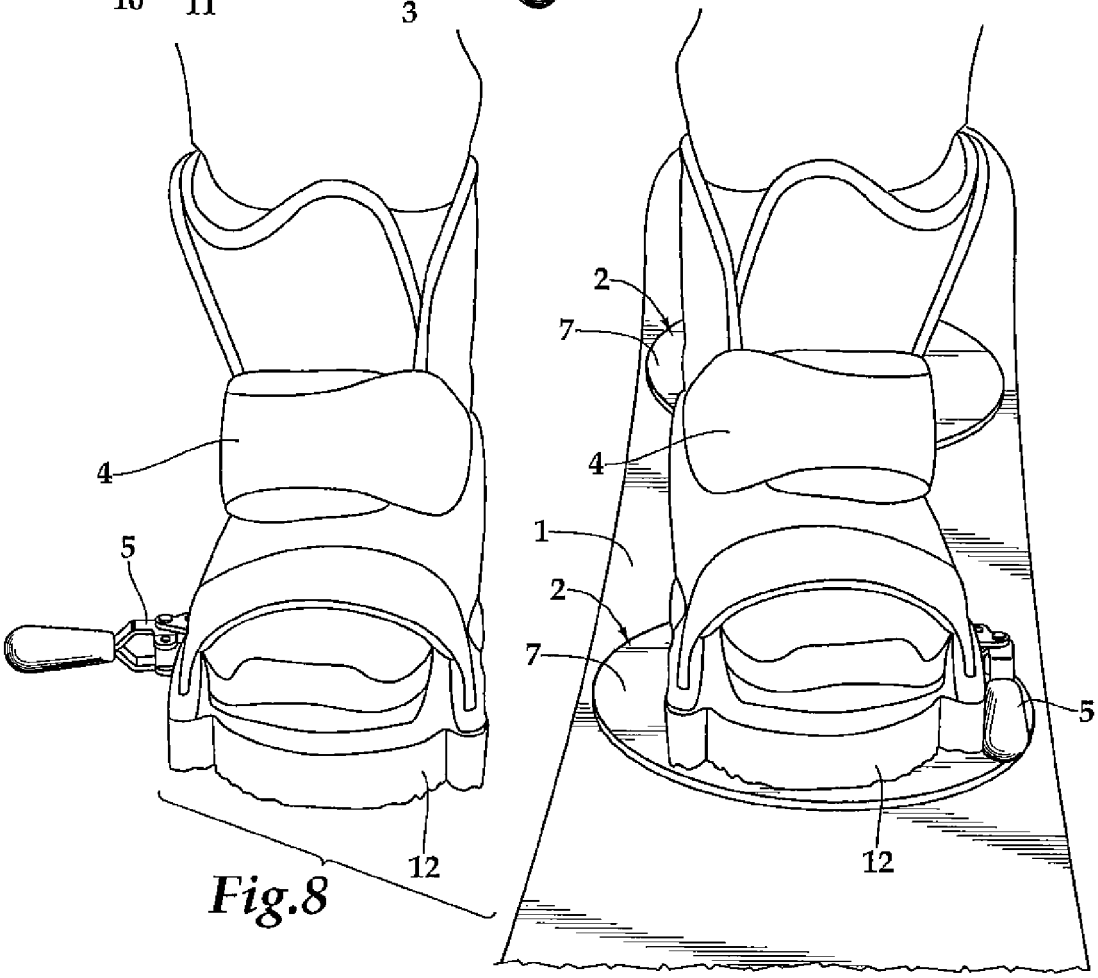
FIG. 8 is a perspective view of the left (or front) foot of the snowboarder rotated so that it is parallel with the snowboard and the right (or rear) foot of the snowboarder lifted off of the snowboard in chairlift position.

FIG. 8 is a perspective view of the left (or front) foot of the snowboarder rotated so that it is parallel with the snowboard and the right (or rear) foot of the snowboarder lifted off of the snowboard in chairlift position. In this figure, the right and left feet are essentially in the same position as that shown in FIG. 7, except that neither the snowboard nor the right foot is touching the ground. This is the position in which the snowboarder would ride the chairlift. Without the present invention, the right (rear) foot would be removed from the strap binding, and the left (front) foot would remain roughly perpendicular to the snowboard. This would require the snowboarder to turn her left foot to the right on the lift so as not to interfere or overlap with the skis or snowboards of others riding on the same chair of the chairlift. By contrast, the present invention allows the snowboarder to comfortably ride the lift with both feet facing forward and the snowboard aligned vertically with the ski hill (i.e., with the front tip of the snowboard facing up the hill).

Figure 9:
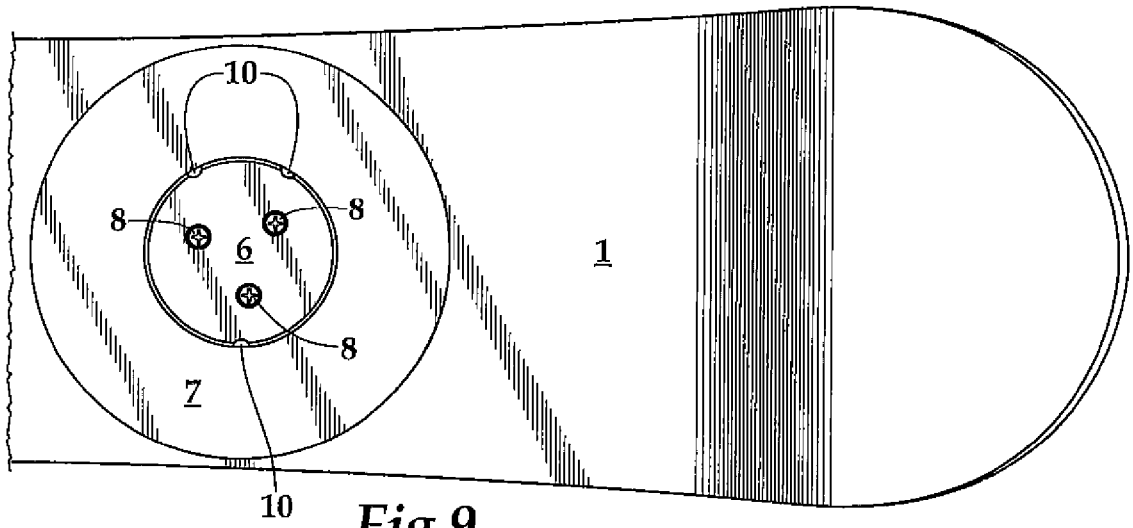
FIG. 9 is a top view of the snowboard interface of the present invention.

FIG. 9 is a top view of the snowboard interface of the present invention. The snowboard interface 2 comprises a first disc 6, a second disc 7, a third disc 9 (see FIG. 10) and one or more bolts 8. The bolts secure the first, second and third discs 6, 7, 9 to the snowboard 1. Although three bolts are shown in this figure, the present invention is not limited to any particular number of bolts. Some strap bindings require only a single bolt, and the present invention could be used with those types of bindings as well.

The first disc 6 lies between the binding interface 3 and the second disc 7, the second disc 7 lies between the first disc 6 and the third disc 9, and the third disc 9 lies between the second disc 7 and the snowboard 1. Although the present invention is shown in the figures with three discs, the second and third discs could be a single second disc. The first disc, second disc and optional third disc are preferably comprised of the same materials as the snowboard bindings; suitable materials include, but are not limited to, nylon, thermoplastic elastomer, aluminum and carbon fiber. In a preferred embodiment, the second disc 7 is comprised of nylon because it provides a rotating surface for the binding interface 3.

Figure 10:
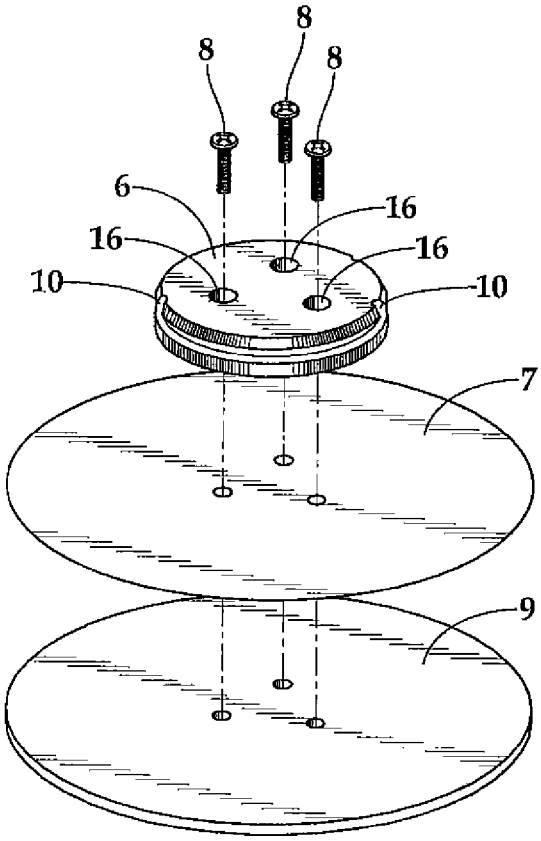
FIG. 10 is an exploded view of the snowboard interface of the present invention.

FIG. 10 is an exploded view of the snowboard interface of the present invention. This figure shows the first, second and third discs 6, 7, 9, as well as the bolts 8 that secure these discs to the snowboard. The outer diameter of the first disc 6 is roughly the same as the inner diameter of the recess 14 in the platform 12 of the binding interface 3 (see FIGS. 16 and 17).

Figure 11:
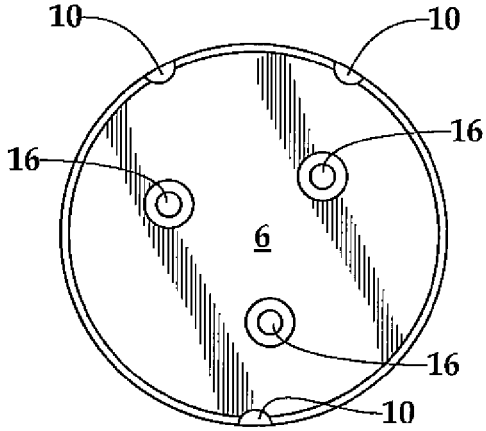
FIG. 11 is a top view of the first disc of the snowboard interface of the present invention.
Figure 12:
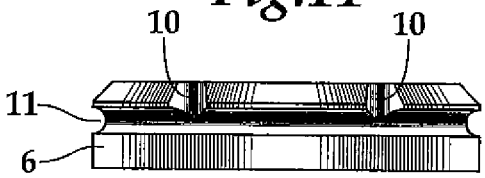
FIG. 12 is a side view of the first disc of the snowboard interface of the present invention.

FIG. 11 is a top view of the first disc of the snowboard interface of the present invention. As shown in this figure, the first disc 6 comprises one or more notches 10. As shown in FIG. 12, the notches 10 extend from the top of the first disc 6 to a channel 11 that extends laterally around the perimeter of the first disc 6. The number of notches 10 corresponds to the number of knobs 15 on the inside of the recess 14 in the platform 12 of the binding interface 3. Holes 16 in the first disc 6 extend vertically through the first disc 6 and preferably allow the heads of the bolts 8 to be recessed within the holes so that they do not come into contact with the top surface of the recess 14 inside the platform 12 of the binding interface 3 when the binding interface 3 is placed on top of the snowboard interface 2.

When the binding interface 3 is placed on top of the snowboard interface 2, the first disc 6 fits inside the recess 14 of the platform 12 of the binding interface 3 (see FIGS. 16 and 17) until the top surface of the first disc 6 abuts up against the top surface of the recess 14 in the platform 12. Thus, the height (top to bottom) of the first disc 6 is roughly equal to the depth (top to bottom) of the recess 14. In order for the first disc 6 to fit into the recess 14, the notches 10 in the first disc 6 must be aligned with the knobs 15 in the recess 14 of the platform 12. The notches 10 and knobs 15 are preferably positioned so that the foot (whether it is the right foot or the left foot) is in an unnatural position when the notches and knobs are aligned (see right foot in FIG. 4). This positioning ensures that the binding interface 3 will not become dislodged from the snowboard interface 2 unless the snowboarder unlocks the clamp and intentionally places her foot in this position. In a preferred embodiment, there are three notches and three knobs; however, the present invention is not limited to any particular number of notches and knobs as long as the number of notches equals the number of knobs.

Figure 13:
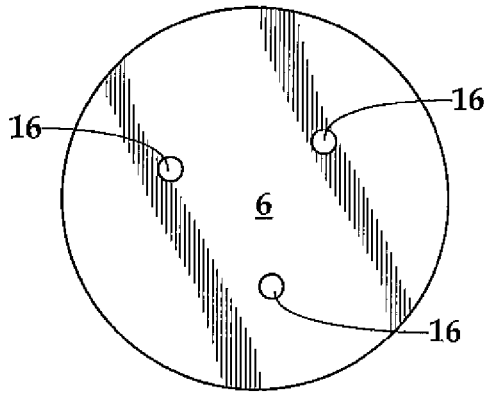
FIG. 13 is a bottom view of the first disc of the snowboard interface of the present invention.

FIG. 12 is a side view of the first disc of the snowboard interface of the present invention. In a preferred embodiment, the top edge of the first disc 6 is beveled to facilitate positioning of the recess 14 on top of the first disc 6. As shown in FIGS. 16-17 and 19-21, the bottom edge of the recess is also preferably beveled, again to facilitate the coupling of the first disc 6 with the recess 14. FIG. 13 is a bottom view of the first disc of the snowboard interface of the present invention.

Figure 14:
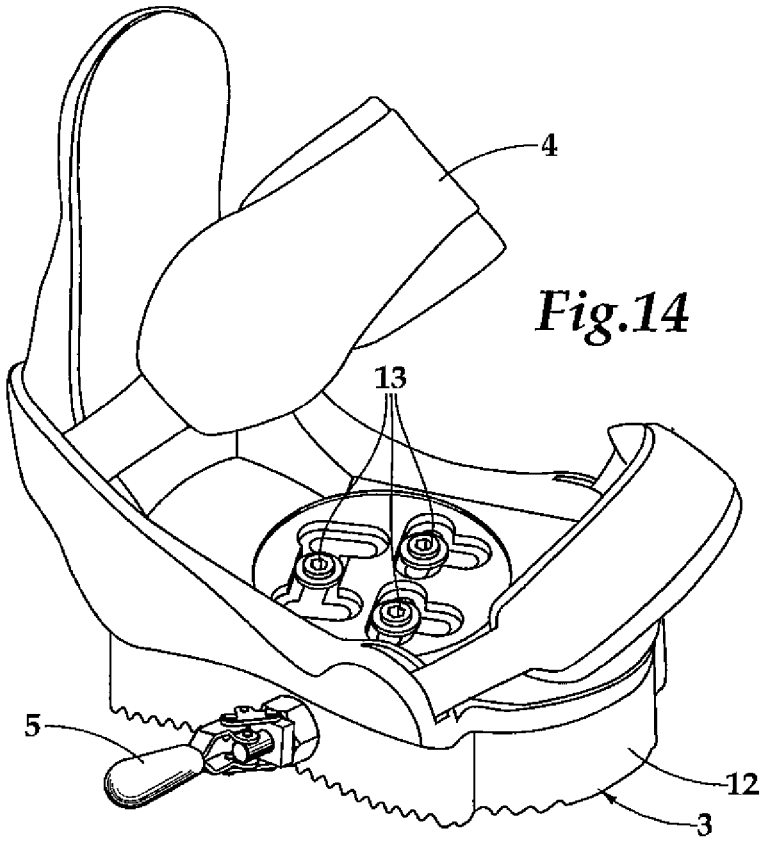
FIG. 14 is a perspective view of the binding interface of the present invention shown attached to a strap snowboard binding.

FIG. 14 is a perspective view of the binding interface of the present invention shown attached to a strap snowboard binding. This figure shows the platform 12 of the binding interface 3. The clamp 5 is in an open (or unlocked) position. The platform 12 is secured to the bottom surface of the binding 4 with bolts 13. Although three bolts 13 bolts are shown in this figure, the present invention is not limited to any particular number of bolts and can be used with any strap binding. As noted above, the present invention enables the snowboarder to "strap in" once without having to strap in and out for the rest of the day. To put the boot back on the board, all the snowboarder has to do is position the binding interface 3 over the snowboard interface 2, as shown in FIGS. 2 and 3, rotate the boot to the desired position, and lock the clamp 5.

Figure 15:
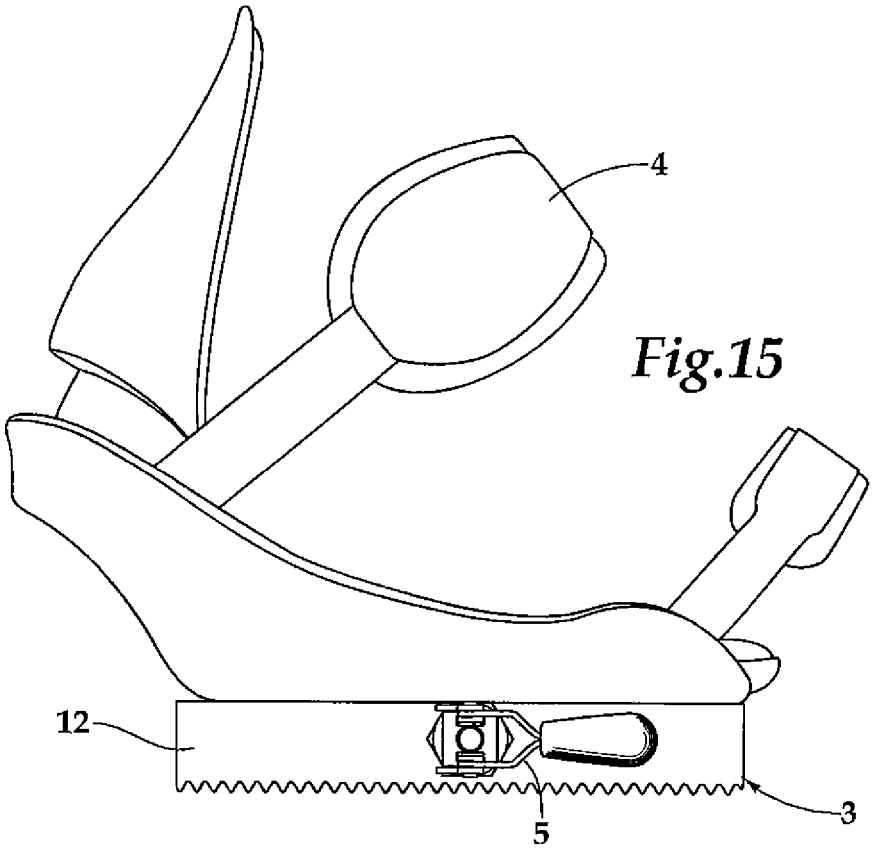
FIG. 15 is a side view of the binding interface of the present invention shown attached to a strap snowboard binding.

FIG. 15 is a side view of the binding interface of the present invention shown attached to a strap snowboard binding. In this figure, the clamp 5 is in a locked position. The platform 12 is preferably made of cast nylon or cast acrylic.

Figure 16:
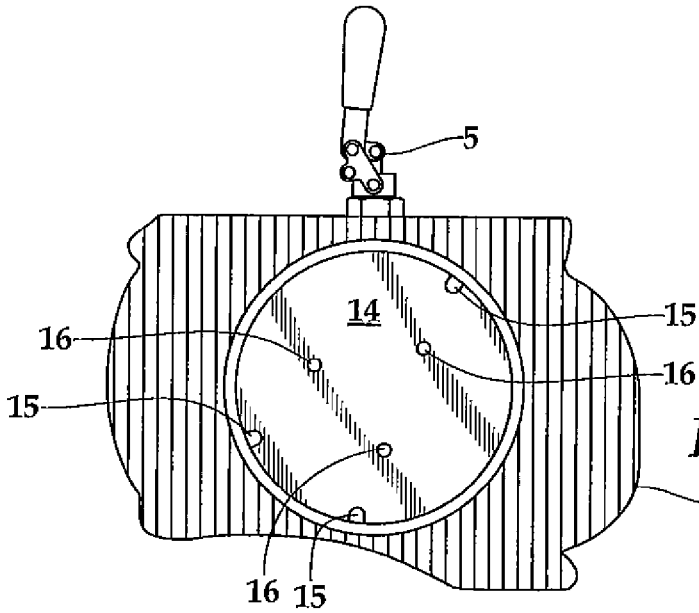
FIG. 16 is a bottom view of the binding interface of the present invention with the clamp in an unlocked position.

FIG. 16 is a bottom view of the binding interface of the present invention with the clamp in an unlocked position. As shown in this figure, the platform 12 comprises a recess 14, and the recess 14 has a plurality of knobs 15 that extend laterally (from the side walls of the recess) into the recess itself. These knobs 15 must align with the notches 10 in the first disc 6 (see FIG. 11) in order for the binding interface 3 to fit over the first disc 6 and lie flat on top of the second disc 7, as shown in FIG. 3. The holes 16 shown in FIG. 16 correspond to the bolts 13 shown in FIG. 14. The purpose of these holes 16 is to secure the platform 12 to the bottom of the binding 4; therefore, the number and position of holes in the top surface of the recess 14 will preferably conform to the number and position of holes in the bottom of the binding 4.

Figure 17:
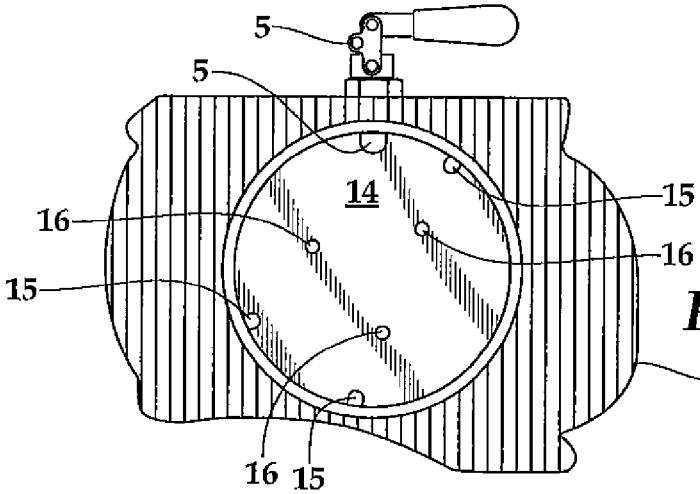
FIG. 17 is a bottom view of the binding interface of the present invention with the clamp in a locked position.

FIG. 17 is a bottom view of the binding interface of the present invention with the clamp in a locked position. This figure is the same as FIG. 16 except that the clamp is shown in a locked position. When the clamp 5 is in a locked position, the tip of the clamp extends into the channel 11 of the first disc 6, thereby locking the platform 12 in place and preventing it from rotating. In a preferred embodiment, the tip of the clamp 5 is made of rubber, TEFLON® or similar material.

Figure 18:
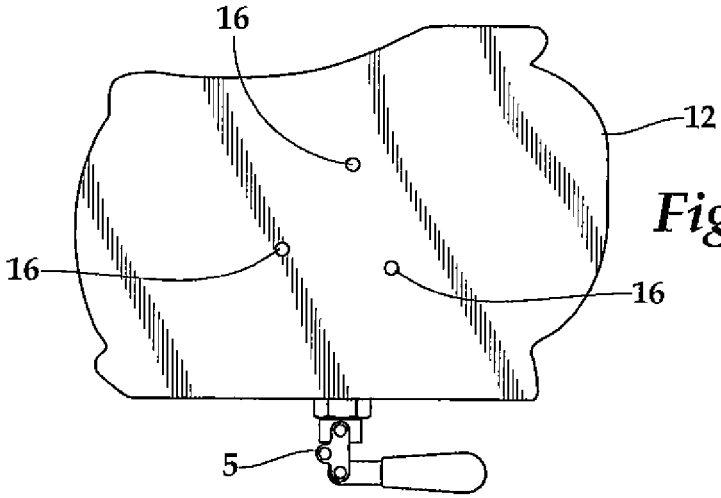
FIG. 18 is a top view of the binding interface of the present invention.

FIG. 18 is a top view of the binding interface of the present invention. The top surface of the platform 12 abuts up against the bottom of the binding 4, and the binding 4 is secured to the platform 12 with bolts 13 (see FIG. 14) that extend through the bottom of the binding 4 and into the platform 12.

Figure 19:
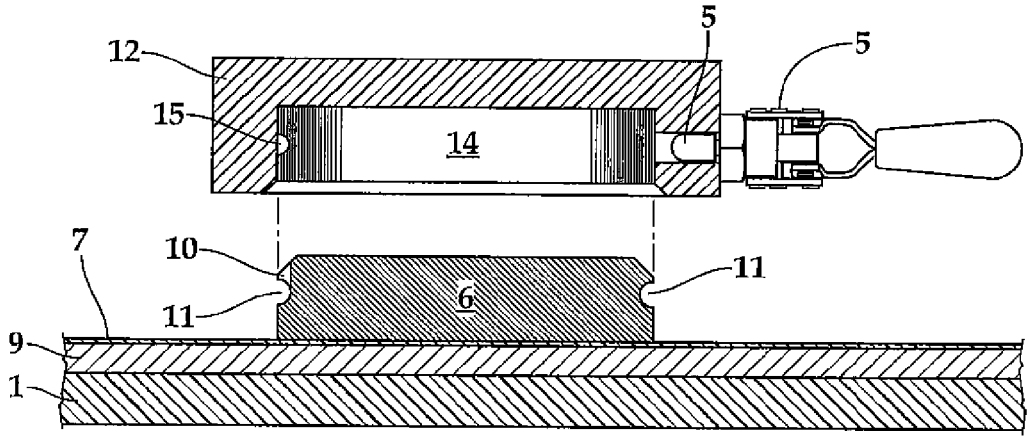
FIG. 19 is a section view of the binding interface and snowboard interface of the present invention with the binding interface positioned above the snowboard interface.

FIG. 19 is a section view of the binding interface and snowboard interface of the present invention with the binding interface positioned above the snowboard interface. As shown in this figure, the knob 15 that extends into the recess 14 in the platform 12 is vertically aligned with a notch 10 on the first disc 6. All of the knobs 15 and notches 10 are so aligned, and the knobs 15 are allowed to travel horizontally within the channel 11 of the first disc 6, thereby allowing the boot to rotate. Once the boot and binding are in the desired position on the snowboard, the clamp 5 is moved to a locked position.

Figure 20:
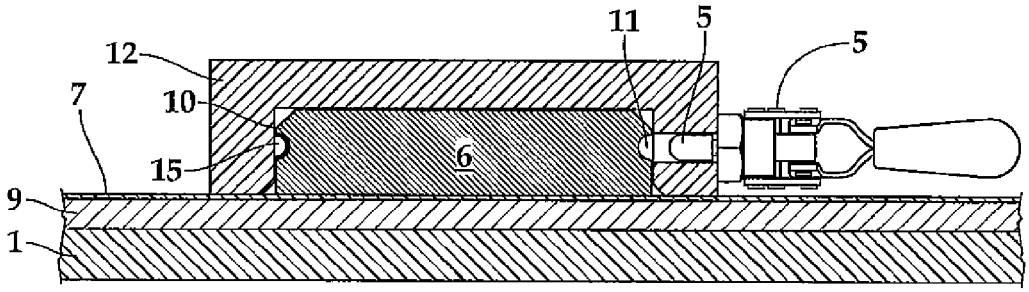
FIG. 20 is a section view of the binding interface and snowboard interface of the present invention with the binding interface positioned on top of the snowboard interface and the clamp in an unlocked position.

FIG. 20 shows the first disc 6 inserted into the recess 14 of the platform such that the bottom surface of the platform 12 lies directly on top of the second disc 7. With the clamp 5 in an unlocked position, the boot can rotate freely on the snowboard because the knobs 15 can travel all the way around the first disc 6 via the channel 11. The boot can only be lifted off of the snowboard interface 2 when the knobs 15 and notches 10 are vertically aligned with one another. As is apparent from this figure, one of the advantages of the present invention is that the first disc 6 is fully covered by the platform 12 when the binding interface 3 is on top of the snowboard interface 2, thereby preventing snow, dirt and/or debris from getting on the first disc 6 or entering the channel 11 and disrupting the smooth rotation of the binding interface 3 on the snowboard interface 2.

Figure 21:
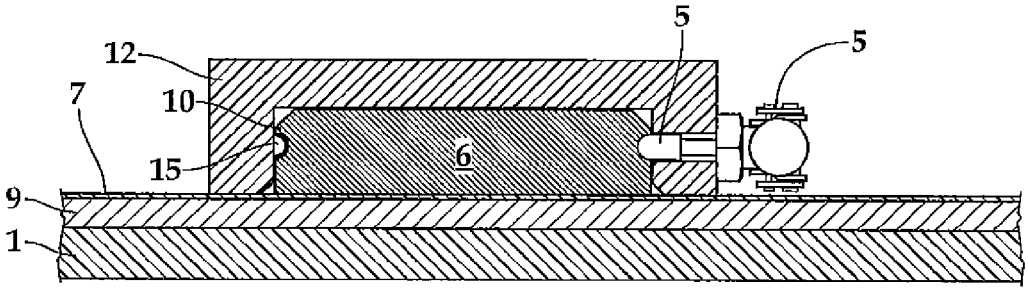
FIG. 21 is a section view of the binding interface and snowboard interface of the present invention with the binding interface positioned on top of the snowboard interface and the clamp in a locked position.

As shown in FIG. 21, when the clamp is in a locked position, the tip of the clamp extends into the channel 11 in the first disc 6, thereby preventing the platform 12 from rotating on the first disc 6. In this manner, the boot can be positioned on the board at any horizontal angle desired by the snowboarder, and angle adjustments can be made quickly and easily, on the slope, without removing the boot from the strap bindings. Thus, the present invention provides the convenience of a step-in binding with the security of a strap binding.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A snowboard binding accessory comprising:

(a) a binding interface comprising a platform; and (b) a snowboard interface comprising a first disc and a second disc;

wherein the platform is fixedly attached to a bottom surface of a snowboard strap binding;

wherein the first and second discs are fixedly attached to a snowboard with the first disc lying on top of the second disc;

wherein the platform comprises a circular recess that fits over the first disc;

wherein the first and second discs each has an outer diameter and the recess has an inner diameter;

wherein the outer diameter of the first disc is roughly the same as the inner diameter of the recess in the platform;

wherein the outer diameter of the second disc is greater than the outer diameter of the first disc;

wherein the second disc provides a rotating surface for the platform;

wherein the first disc comprises a top surface, a circular perimeter, and a channel that extends around the entire circular perimeter of the first disc;

wherein a plurality of notches extend from the top surface of the first disc to the channel;

wherein the recess in the platform has side walls, and a plurality of knobs extend horizontally from the side walls into the recess;

wherein the number of knobs equals the number of notches;

wherein to position the platform on the snowboard interface, the knobs are lined up with the notches, and the first disc is inserted into the recess; and wherein the knobs move horizontally within the channel around the entire circular perimeter of the first disc, thereby allowing the platform to rotate three hundred and sixty degrees.

2. The snowboard binding accessory of claim 1, wherein the first disc has a height and the recess has a depth, and the height of the first disc is roughly equal to the depth of the recess.

3. The snowboard binding accessory of claim 1, wherein each knob has a length and each notch has a depth, and the length of each knob roughly equals the depth of each notch.

4. The snowboard binding accessory of claim 1, further comprising a clamp with a tip, wherein the clamp is positioned such that when the clamp is in a locked position, the tip of the clamp extends into the channel in the first disc, thereby preventing the platform from rotating, and wherein the platform rotates freely on the snowboard when the clamp is in an unlocked position.

5. The snowboard binding accessory of claim 1, wherein the first disc comprises a beveled top edge and the recess comprises a beveled bottom edge, and the beveled edges of the first disc and recess facilitate the coupling of the first disc and recess.

6. The snowboard binding accessory of claim 1, wherein the channel in the first disc is fully covered by the platform when the platform is on top of the first disc, thereby preventing snow, dirt and debris from entering the channel and disrupting the smooth rotation of the platform.

* * * * *